US007472869B2

(12) United States Patent
Beller

(10) Patent No.: US 7,472,869 B2
(45) Date of Patent: Jan. 6, 2009

(54) BALANCING ASSEMBLY FOR ROTATING CYLINDRICAL STRUCTURES

(75) Inventor: Larry D. Beller, Norman, OK (US)

(73) Assignee: Construction Technology, Inc., Noble, OK (US)

( * ) Notice: Subject to any disclaimer, the term of this patent is extended or adjusted under 35 U.S.C. 154(b) by 0 days.

(21) Appl. No.: 11/465,737

(22) Filed: Aug. 18, 2006

(65) Prior Publication Data

US 2007/0007395 A1 Jan. 11, 2007

(51) Int. Cl.
*F16L 5/00* (2006.01)

(52) U.S. Cl. ..... 248/56; 248/62; 248/300

(58) Field of Classification Search ..... 248/56, 248/62, 68.1, 300, 200, 201; 404/75, 72, 404/90

See application file for complete search history.

(56) References Cited

U.S. PATENT DOCUMENTS 3,925,854 A * 12/1975 McFadden ..... 29/252
4,608,170 A * 8/1986 LaValley ..... 210/404
4,692,058 A * 9/1987 Mengel ..... 404/72
5,026,205 A * 6/1991 Gorski et al. ..... 404/72
5,165,160 A * 11/1992 Poncelet ..... 29/464
5,921,706 A * 7/1999 Manatt et al. ..... 404/72
6,211,587 B1 * 4/2001 Enomoto et al. ..... 310/52

* cited by examiner

*Primary Examiner*—Amy J. Sterling
(74) *Attorney, Agent, or Firm*—Tomlinson & O'Connell, PC

(57) ABSTRACT

The present invention provides an apparatus and a method for compensating for small variations in balance and alignment when supporting and rotating a massive cylindrical drum. The apparatus comprises a self-aligning flange having projections spaced 90° apart about the circumference, or rim, of the flange. The projections are inserted into sliding relationship with elongate slots within a fixed supporting frame so that the plane of the self-aligning flange is allowed to dynamically adjust to small oscillations or movements of the centerline of the rotating drum as it rotates.

12 Claims, 9 Drawing Sheets

BALANCING ASSEMBLY FOR ROTATING CYLINDRICAL STRUCTURES

REFERENCE TO PENDING APPLICATIONS

This application claims benefit of U.S. Provisional Patent Application Ser. No. 60/427,915 filed on 20 Nov. 2002 entitled BALANCING ASSEMBLY FOR ROTATING CYLINDRICAL STRUCTURES and benefit of U.S. patent application Ser. No. 10/717,114 filed on 19 Nov. 2003 entitled BALANCING ASSEMBLY FOR ROTATING CYLINDRICAL STRUCTURES now U.S. Pat. No. 7,104,510.

REFERENCE TO MICROFICHE APPENDIX

This application is not referenced in any microfiche appendix.

BACKGROUND OF THE INVENTION

1. Field of the Invention

The present invention relates to balancing assemblies for rotating members. More particularly, the invention relates to self-aligning balancing assemblies for large cylindrical members, and even more particularly, to a self-aligning flange for mounting on opposing ends of a large cylindrical drum assembly.

2. Background

Industry is replete with many examples of large cylindrical drums that must be rotated for various reasons. For example, factories in the paper industry must employ large heavy drum assemblies for receiving and storing rolls of kraft paper. The road construction industry uses road machines having large drums with cutting blades embedded on the drum surface for abrading rock during road construction.

These cylindrical drum assemblies are generally massive and require a high torque motor or engine to initiate rotation of the drum and to maintain rotation during operation. Although the drum assemblies are rotated at a low number of revolutions per minute (rpm), the high mass of the drum results in several problems. First, the centrifugal force produced by the rotation of a high mass structure is extreme even at low rpm and necessitates a robust, heavy duty gear box to transmit the rotational force of the motor to the drum. Often, a separate gear box and motor assembly is used on each of the opposing ends of the axis about which the drum rotates. In such a configuration, one gear box and motor assembly is structured for clockwise rotation and the opposing gear box and motor assembly is structured for counter-clockwise rotation so that their rotational force combines to rotate the drum in a single direction. These gear box and motor assemblies distribute the force required to rotate the drum so that less robust gear boxes and motors may be used.

Second, if the drum is unbalanced around the axis of rotation so as to produce an oscillating radial force, this radial force will excessively wear the gear box and motor so as to cause premature failure. When using a pair of opposing gear box and motor assemblies, the centerline of both assemblies must be perfectly aligned to reduce radial forces and resultant wear on the bearings of these assemblies; otherwise the misalignment will cause premature failure of the bearings. This alignment may be achieved by precise machining and balancing of the drum. However, such machining and balancing for drums with diameters in excess of 12 inches and lengths in excess of five feet requires large, heavy duty, and expensive machines to turn the massive drums and cut away excess metal. High precision is difficult to attain when dealing with such heavy, bulky structures. Additionally, the removal, shipping, and replacement of the drum in its installed location is expensive in terms of required man power. The removal, shipping, and replacement can also be further complicated by the fact that machines employing such heavy drums, e.g. road equipment, are often used in remote locations where transportation is difficult and knowledgeable maintenance personnel are unavailable.

Third, during use, the drum is loaded by the work against which it rotates, e.g. the road surface for a cutting drum or the uneven winding of paper on a takeup drum in a paper plant. This loading coupled with the massiveness of the drum causes a small amount of deflection which also results in unbalancing of the drum assembly.

Fourth, even if the drum is perfectly balanced about its axis of rotation, the gear box must be positioned precisely so that the shaft is exactly collinear with the axis of rotation. This requires that the mounting surfaces for the gear box must be machined to very precise tolerances. On a large machine, this is very difficult and expensive, and, while it improves the initial misalignment, it does not help with the deflection problem.

As can be seen, there is a need for a method and apparatus to maintain the balance of a massive rotating drum assembly, reduce the requirement for close precision in the physical balancing process for the drum, and dynamically adjust for in-use deflection of the drum so that balance about the axis of rotation is maintained.

SUMMARY OF THE INVENTION

The present invention satisfies the needs discussed above. In one aspect of the invention, an apparatus comprises a self-aligning flange for aligning a centerline of a motive force means with a centerline of a rotating member supported by a frame, where the self-aligning flange comprises an annular ring providing a mounting surface for the motive force means, the annular ring having a rim and four radially aligned projections on the rim with the projections circumferentially spaced 90° apart; and a circular well in the frame with the circular well having an interior surface with four slots therein, each slot longitudinally aligned with the centerline of the rotating member and spaced about the interior surface to receive the projection of the annular ring in axial sliding contact therein. In this arrangement, the centerline of the motive force means is aligned with the centerline of the rotating member and the projections move axially within their respective slots as the rotating member rotates so that the centerline of the motive force means maintains alignment with the centerline of the rotating member as the centerline of the rotating member oscillates from unbalancing forces.

In another aspect of the invention, a motive force means is provided for both ends of a rotating cylindrical drum, where the motive force means is mounted on a self-aligning flange having the configuration described above.

In still another aspect of the invention, a cutting apparatus having a self-aligning drum assembly is provided, where each end of the drum is maintained in rotation by a gear box and a motor assembly, the gear box and motor assembly being held in alignment with each other by a pair of annular rings supporting the gear box and motor assembly, the rim of each annular ring being allowed to move axially within a limited distance, the movement being urged by the oscillations generated by any imbalance from (a) the inherent rotational symmetry of the drum, (b) deflections from the load applied to the drum, or (c) departures in the mounting surfaces from normal (90°) orientation with the centerline of the drum.

These and other features, aspects and advantages of the present invention will become better understood with reference to the following drawings, description and claims. For a better understanding of the invention, its operating advantages and the specific objects attained by its uses, reference should be made to the accompanying drawings and descriptive matter in which there are illustrated preferred embodiments of the invention. The foregoing has outlined some of the more pertinent objects of the invention. These objects should be construed to be merely illustrative of some of the more prominent feature and applications of the present invention. Many other beneficial results can be attained by applying the disclosed invention in a different manner or by modifying the invention within the scope of the disclosure. Accordingly, other objects and a fuller understanding of the invention and the detailed description of the preferred embodiments in addition to the scope of the invention illustrated by the accompanying drawings.

DETAILED DESCRIPTION OF THE INVENTION

The following detailed description shows the best currently contemplated modes of carrying out the invention. The description is not to be taken in a limiting sense, but is made for the purpose of illustrating the general principles of the invention and the best mode for practicing the invention, since the scope of the invention is best defined by the appended claims. The invention is capable of other embodiments and of being practiced or carried out in a variety of ways. It is to be understood that the phraseology and terminology employed herein are for the purpose of description and not of limitation.

Figure 1:
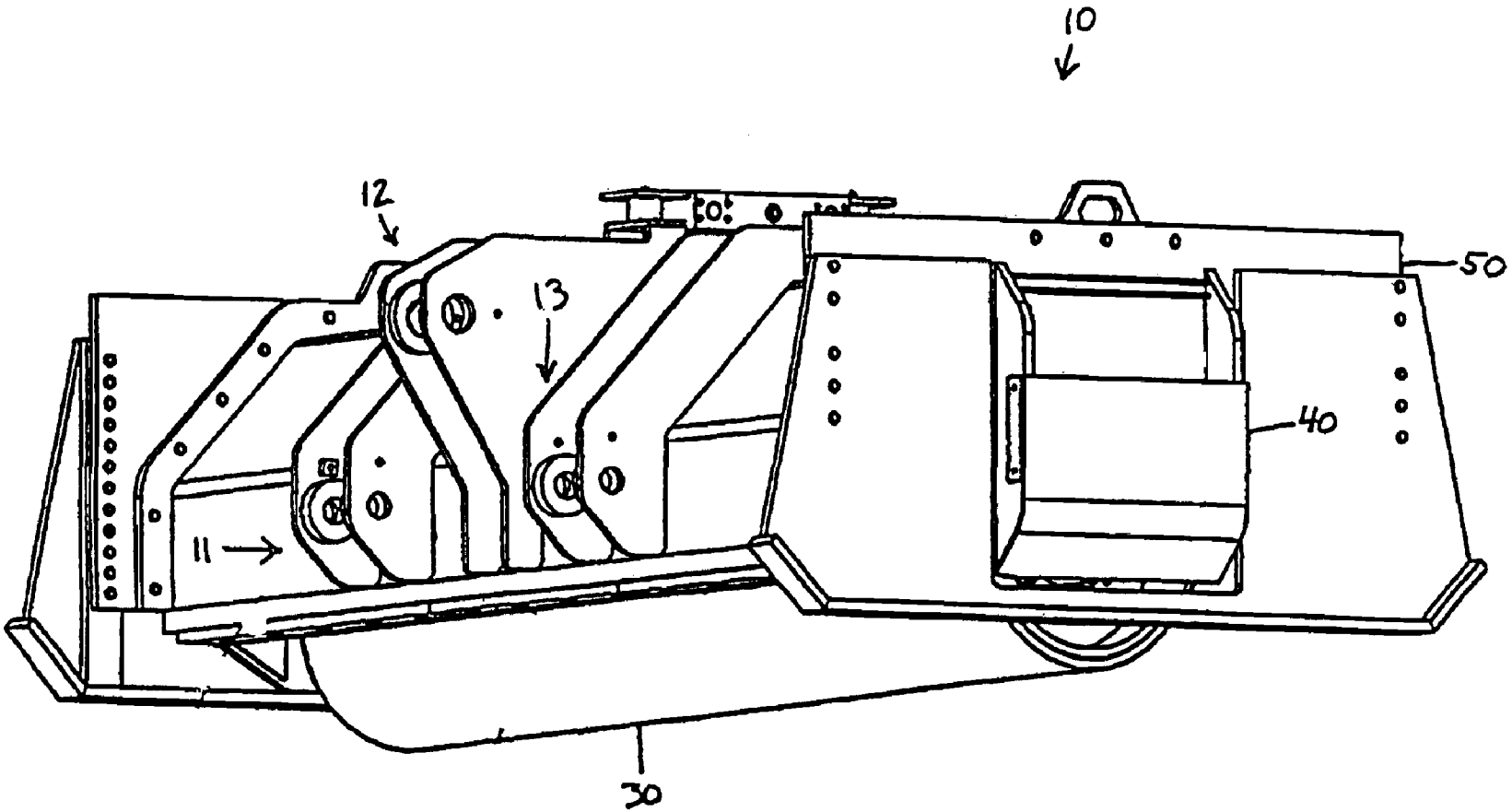
FIG. 1 is a perspective view of a cutting assembly supporting a rotating drum driven by a gear box and motor axially positioned at either end of the drum and covered by a protective panel.

Referring to FIG. 1, a cutting apparatus 10 is shown to illustrate application of the invention to a specific device for illustrative purposes. The cutting apparatus 10 is used for grinding rock and hard earth for the preparation of road beds and is configured for mounting on a tractor, the tractor having an arm connecting to the cutting apparatus 10 at the connection points 11, 12, and 13. A frame supports a rotating drum 30 at either end of drum 30. A gear box and motor are located at either end of drum 30 and are covered by a protective panel 40 attached to an end plate 50. The surface of the drum 30 supports cutting blades (not shown) for abrading rock and hard earth as the drum rotates and is brought into contact with said rock and earth. It should be noted that contact with the rock and hard earth produce small deflections in the rotating drum which cause it to be come slightly unbalanced.

Figure 2:
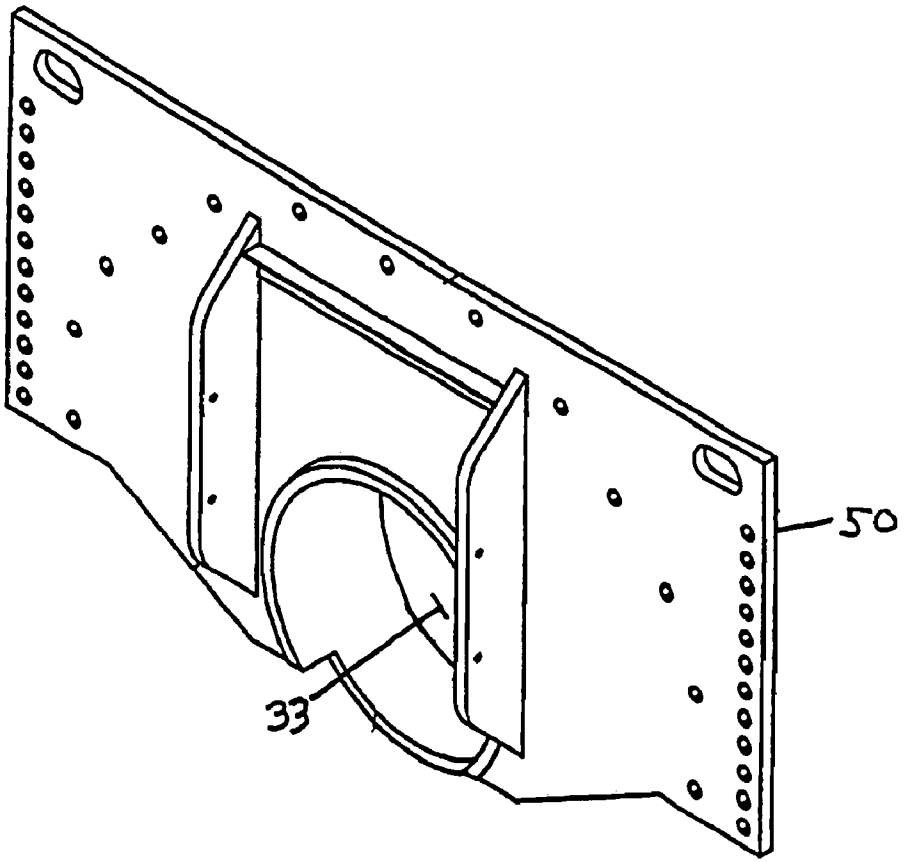
FIG. 2 is a perspective view of an end plate of the cutting assembly shown in FIG. 1 with the protective panel removed to show the well into which the drum is inserted and supported.
Figure 3B:
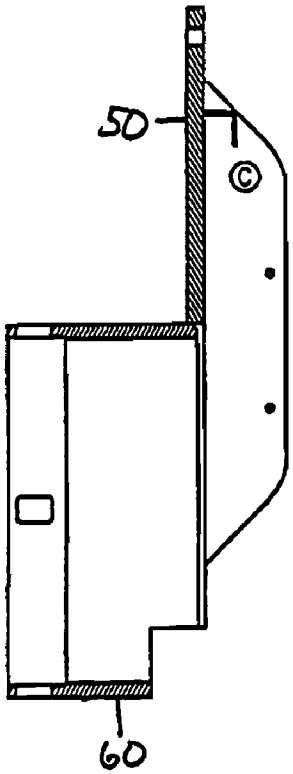
FIG. 3B is a sectional view taken from FIG. 3A showing of the support housing within which the drum is inserted and its relationship with the end plate.
Figure 3A:
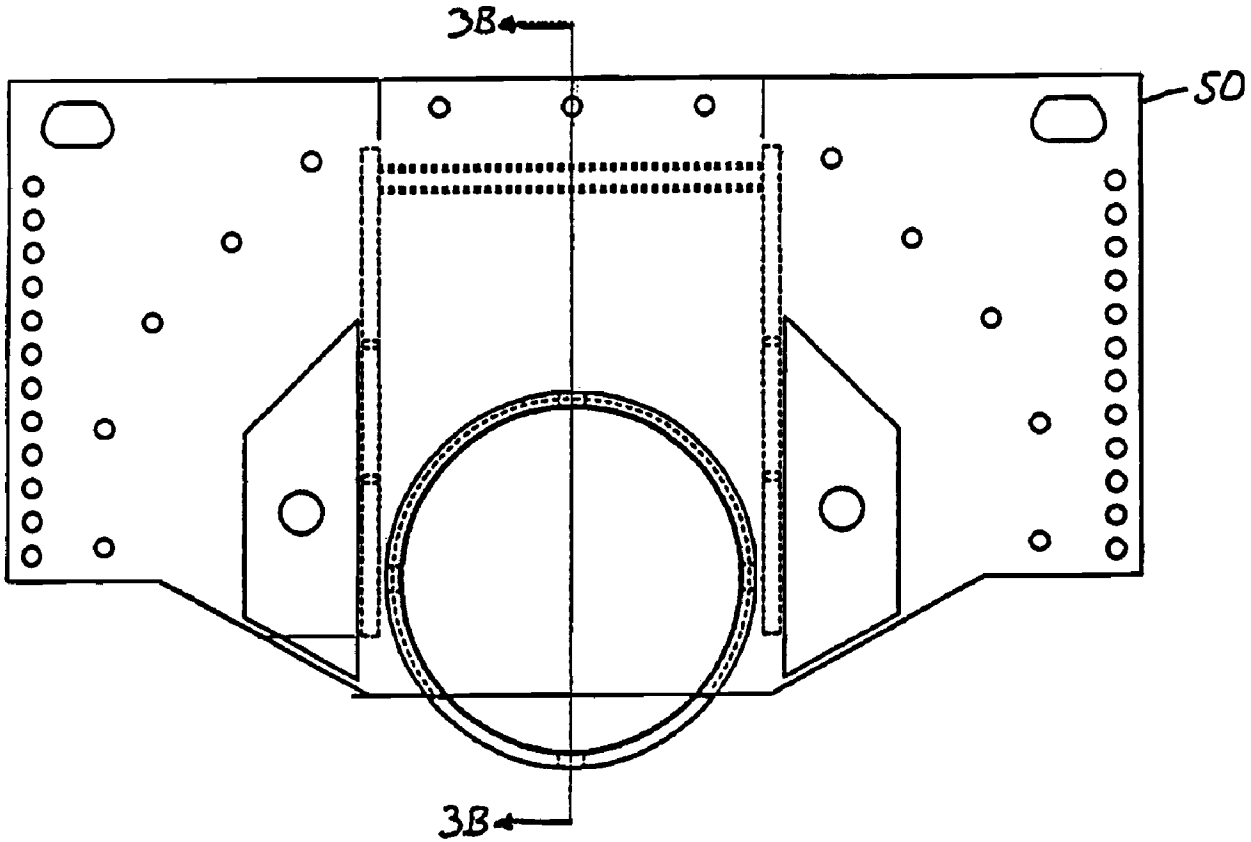
FIG. 3A is a plane view of the end plate showing details of its construction.
Figure 3C:
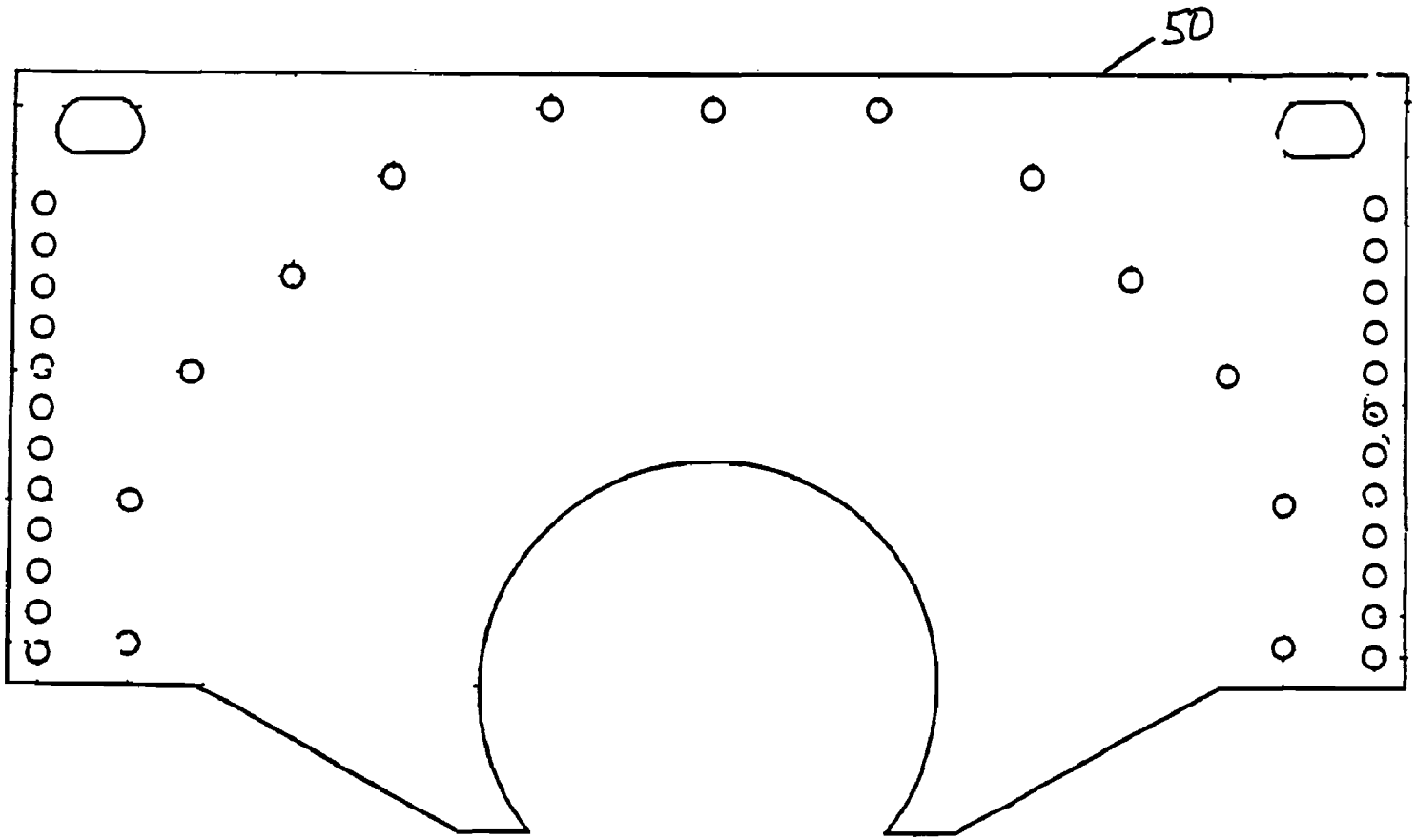
FIG. 3C shows the layout of the end panel.
Figure 4B:
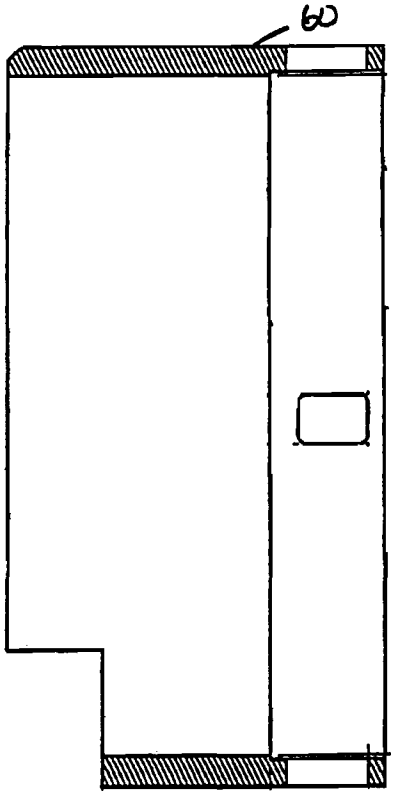
FIG. 4B is a sectional view of the support housing shown in FIG. 4A showing placement of the slots therein.
Figure 4A:
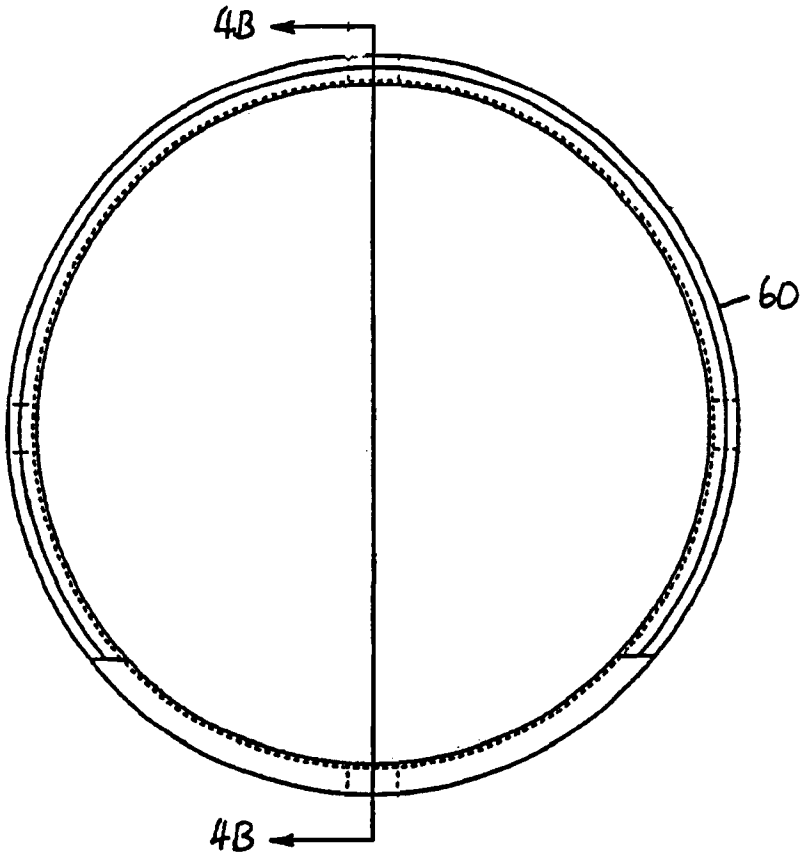
FIG. 4A is a plane view of the support housing shown previously in FIGS. 3A and 3B.

Referring now to FIG. 2, the end plate 50 is shown with the protective panel 40 removed to expose the circular hole into which drum 30 is inserted.

Referring now to FIGS. 3A, 3B, 3C, 4A, and 4B, the details of the end plate 50 are shown and its relationship with the support housing 60 within which the drum 30 rotates.

Figure 5:
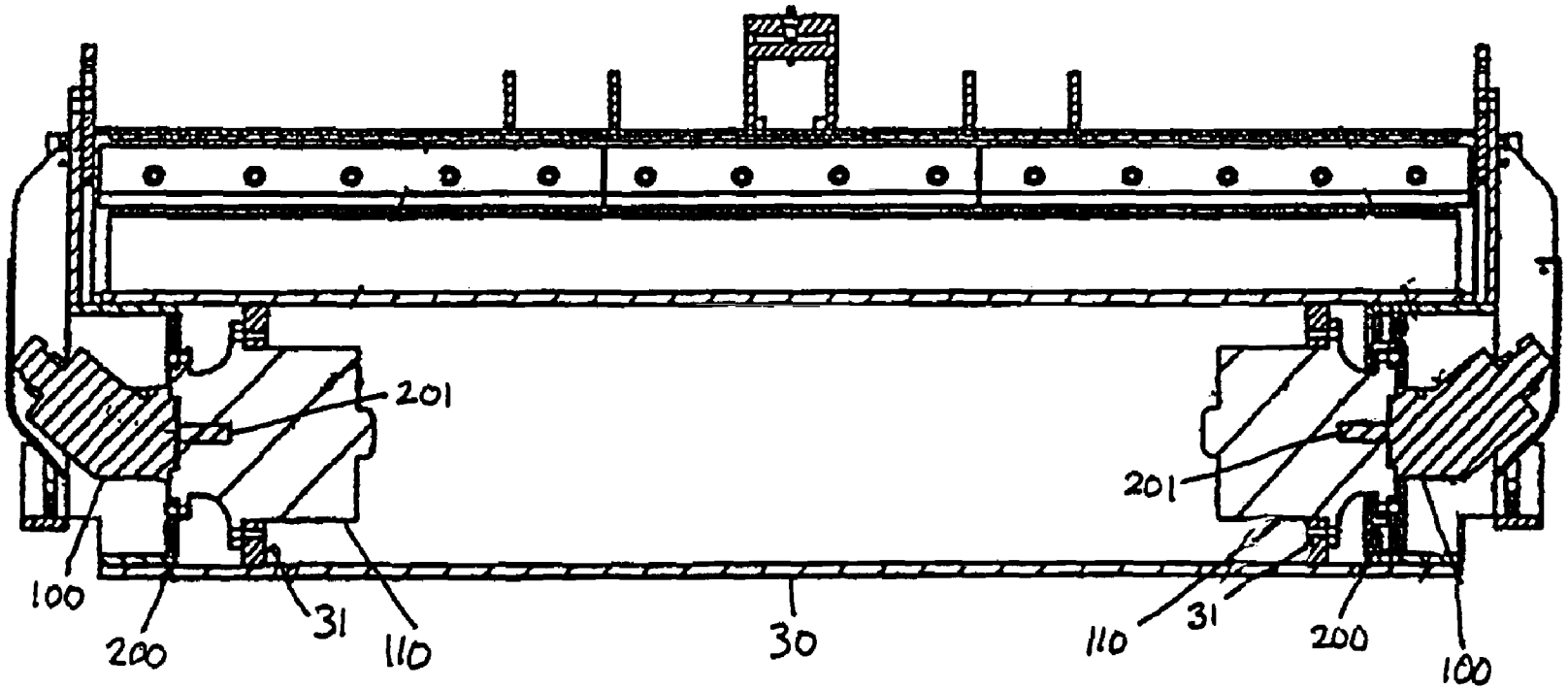
FIG. 5 is a longitudinal sectional view of the cutting assembly of FIG. 1, illustrating the placement of the hydraulic motors and the gear boxes on each end of the drum assembly and the placement of the self-aligning flange with respect to the motors and gear boxes.
Figure 6:
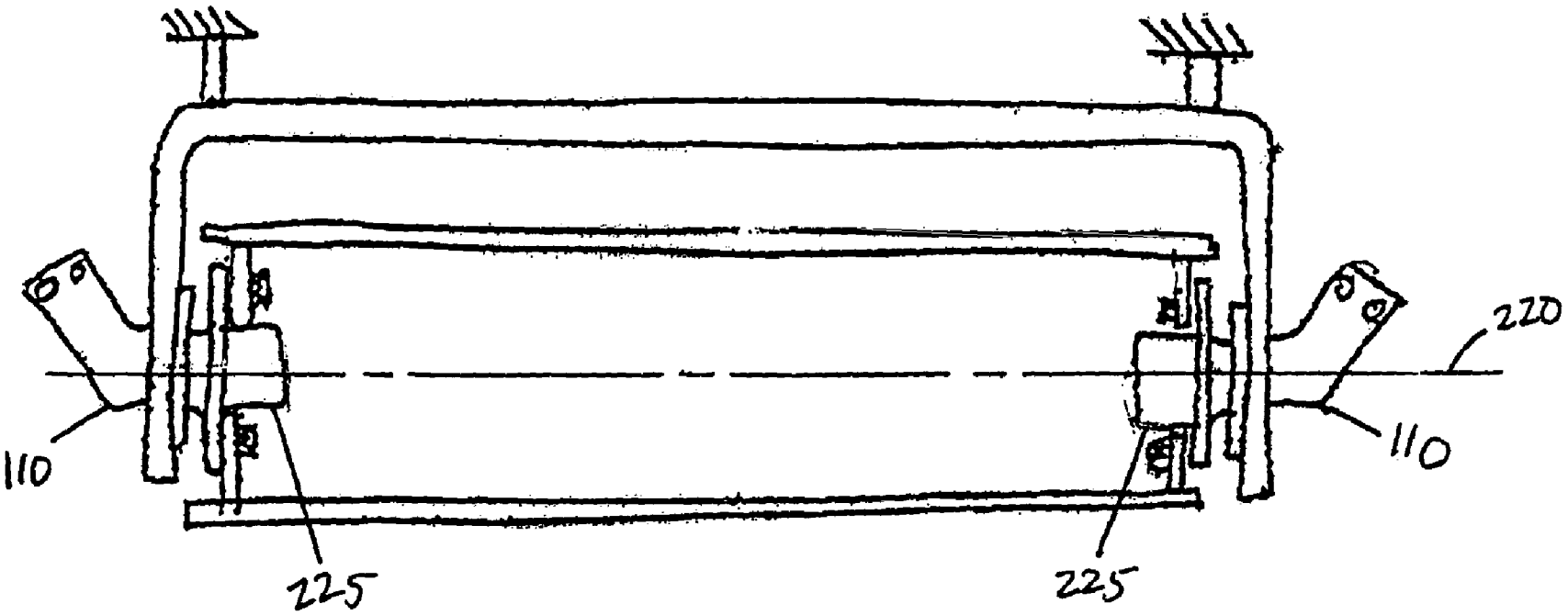
FIG. 6 is a sectional view showing more details of the mounting arrangement of the motors and gear boxes with respect to the centerline of the drum assembly.

FIG. 5 shows a cross sectional view of the drum assembly. At each end of drum 30 is inserted a gear box 110 which is fixedly bolted to an internal flange 31 within each end of drum 30 so that the centerline 225 (FIG. 6) of each gear box 110 is generally aligned with the centerline 220 (FIG. 6) of the drum assembly. Small deviations from the alignment of the centerlines are compensated for by the self-aligning flange, which will be described later. A hydraulic motor 100 is provided at each end of the drum 30 and fixedly mounted to self-aligning flange 200. The shaft 201 of motor 100 is inserted into the respective gear box 110 so that the hydraulic motor 100 and gear box 110 provide motive force to the drum assembly.

Figure 7:
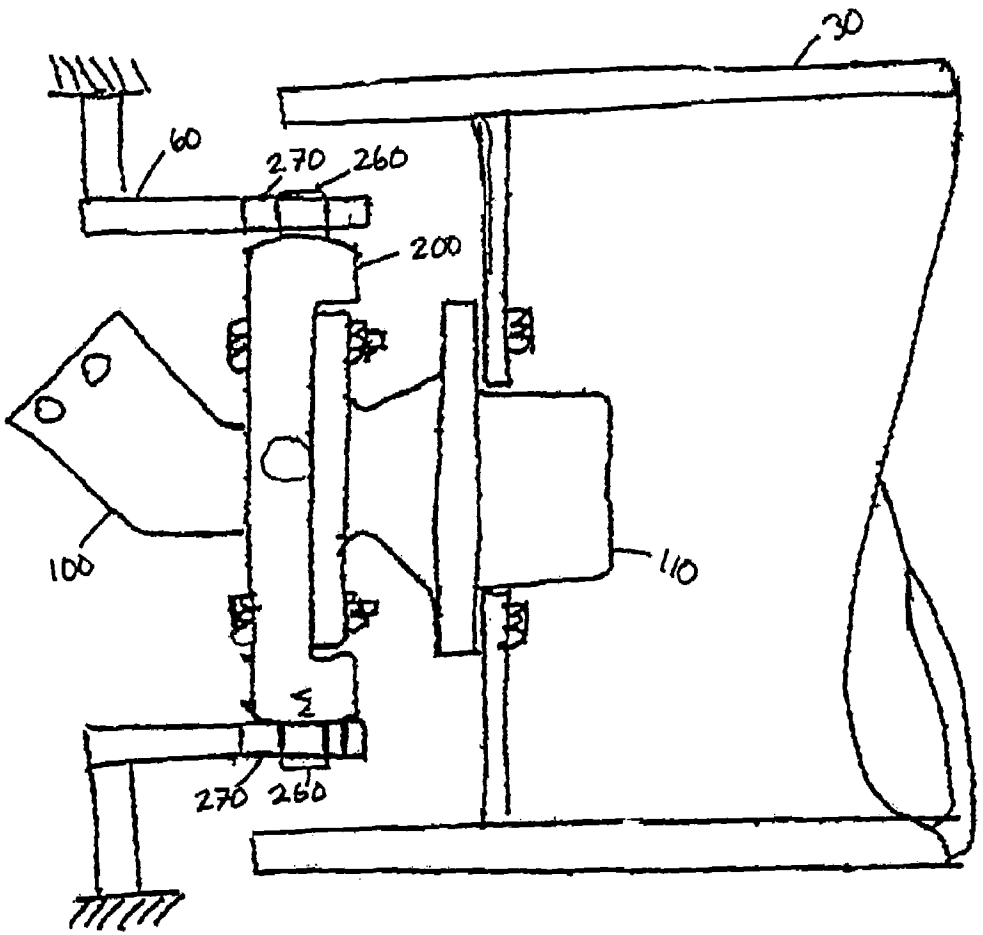
FIG. 7 is a close up, sectional view showing still more details on the projections from the self-aligning flange and the placement of the slots into which the projections are inserted.
Figure 8B:
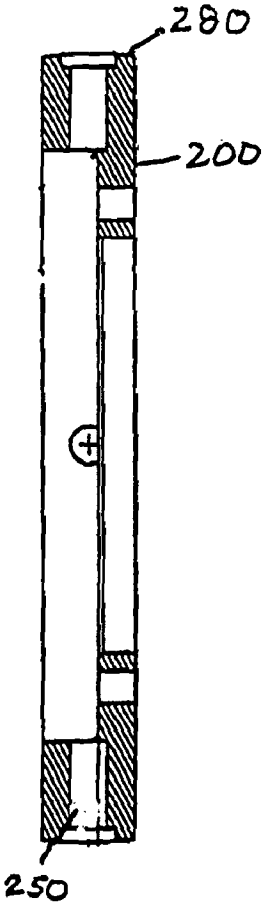
FIG. 8B is a side view of the self-aligning flange taken from FIG. 8*a*.
Figure 8A:
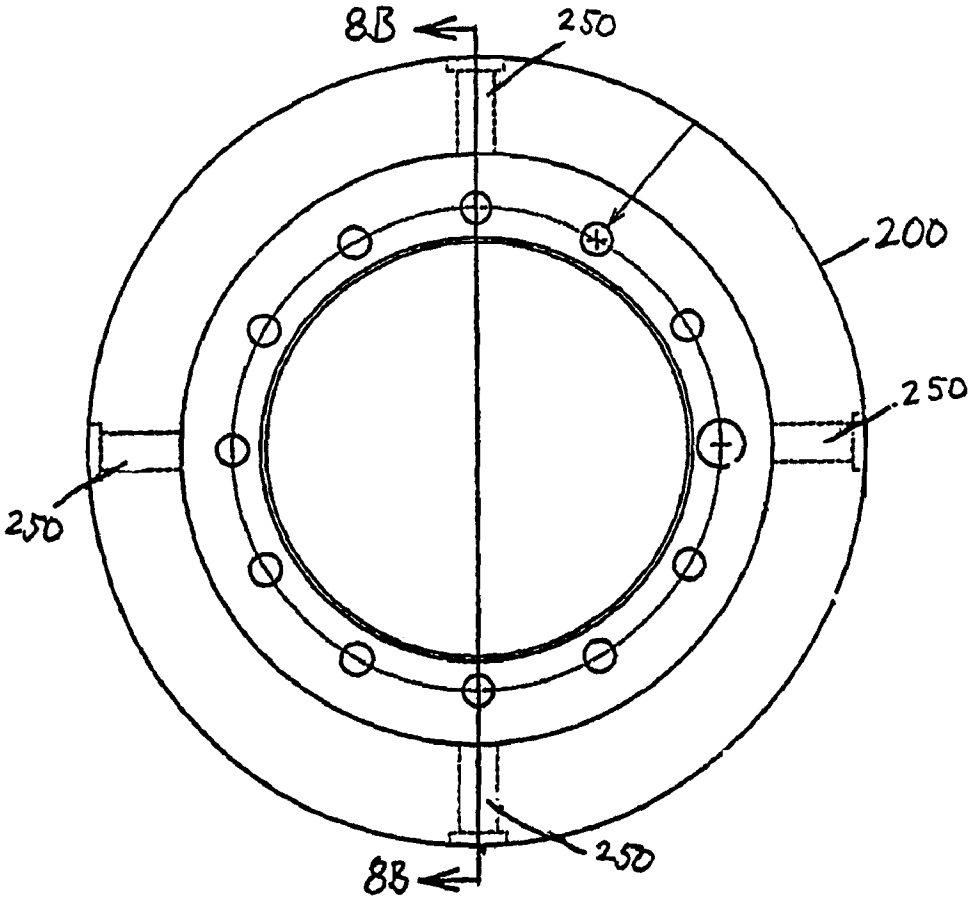
FIG. 8A is a plane view of the self-aligning flange illustrating the placement of the holes from which the projections extend along the circumference thereof.

Referring now to FIGS. 7, 8A, and 8B, the self-aligning flange 200 is shown in greater detail. FIG. 8A shows a front view of the self-aligning flange 200 with four bolt holes 250 bored into the rim. Projections 260, in this case bolts, are inserted into holes 250 so that they project beyond the rim of the flange 200. These projections 260 are inserted into elongate slots 270 in the support housing 60 with the long dimension aligned in an axial direction with reference to centerline 220. Note that the outer rim 280 of the self-aligning flange 200 is curved so that it generally follows a circle drawn with its center at the center of the self-aligning flange 200.

Fixedly mounting the gear box 110 to the self-aligning flange 200 with a spherical outer diameter allows the gear box 110 to align itself with the opposite gear box unit. Projections 260 in the rim of the self-aligning flange 200 engage slots 270 cut in the support housing 60 to prevent rotation while still allowing movement for alignment and for thermal expansion. Misalignment of the mount surfaces of the cutter drum are also compensated for.

Other modifications of the invention could be made without departing from its scope. For example, the inner diameter or surface of the support housing 60 could also be made spherical to provide increased bearing area and reduced wear. However, this variation loses the axial movement that compensates for length variations due to manufacturing tolerances or thermal expansion. As another example, the self-aligning flange could be manufactured with grooves cut in the rim, or outer diameter, to match "keys" or splines in the inner surface of the support housing. In other words, the projections would in this example extend from the inner surface of the support housing rather from from the outer surface, or rim, of the self-aligning flange.

As has been demonstrated, the present invention provides an advantageous apparatus and method for maintaining alignment and balance of a massive rotating cylindrical drum within close tolerances. While the preferred embodiments of the present invention have been described, additional variations and modifications in those embodiments may occur to those skilled in the art once they learn of the basic inventive concepts. Therefore, it is intended that the appended claims shall be construed to include both the preferred embodiment and all such variations and modifications as fall within the spirit and scope of the invention.

I claim:

1. A work machine comprising:

a frame comprising a circular well;

a first motive force means supported by the frame;

a cylindrical member rotatable in response to operation of the motive force means;

a first flange operatively connected to the motive force means and the cylindrical member, the flange comprising:

an annular ring disposed within the circular well; and a plurality of movable radial projections to operatively engage the circular well to maintain a rotational balance of the cylindrical member during operation of the motive force means.

2. The work machine of claim 1 further comprising a plurality of slots within an inner surface of the circular well to receive a corresponding radial projection, wherein the radial projection is movable axially within the slot during operation of the motive force means and the cylindrical member.

3. The work machine of claim 1 wherein the cylindrical member comprises a first and a second end; where the first motive force means and the first flange are disposed at the first end of the cylindrical member.

4. The work machine of claim 3 comprising a second flange and a second motive force means operatively disposed at the second end of the cylindrical member.

5. The work machine of claim 1 wherein the circular well comprises a plurality of slots disposed about a circumference of the well to matingly engage the plurality of radial projections.

6. An apparatus comprising:

a frame comprising a circular well;

a motive force means which rotates a rotatable member; and a flange comprising:

an annular ring comprising a mounting surface for the motive force means and a rim to operatively engage the circular well; and a plurality of radially aligned projections supported by the annular ring, wherein the radially aligned projections are disposed to engage the circular well and axially movable to maintain substantial collinear alignment of the centerline of the motive force means and the centerline of the rotatable member and such that the rotatable member is axially movable relative to the circular well.

7. The flange of claim 6 wherein the circular well comprises a plurality of slots disposed to receive a corresponding radially aligned projection.

8. The flange of claim 6 wherein the rotatable member comprises a cylindrical drum.

9. The flange of claim 6 wherein said motive force means is a gear box in combination with a motor.

10. The flange of claim 7 wherein the number of said plurality of slots and the number of said plurality of radially aligned projections is four.

11. The flange of claim 6 wherein each of the radially aligned projections comprises an elongate pin and wherein the annular ring comprises a plurality of radial bores to support the elongate pin in a radial orientation relative to the centerline of the rotatable member.

12. The flange of claim 6 wherein the motive force means is supported at a first end of the rotating cylindrical drum and mounted on the flange.

* * * * *